US007044424B2

(12) United States Patent
Robertson et al.

(10) Patent No.: US 7,044,424 B2
(45) Date of Patent: May 16, 2006

(54) ARTICLE HOLDER FOR A BARREL COOLER

(75) Inventors: James David Robertson, Atlanta, GA (US); David Bernstein, Marietta, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 10/930,457

(22) Filed: Aug. 31, 2004

(65) Prior Publication Data

US 2006/0043248 A1 Mar. 2, 2006

(51) Int. Cl.
*A47K 1/08* (2006.01)
*B65D 25/04* (2006.01)

(52) U.S. Cl. ..... 248/311.2; 248/211; 220/533; 224/567; 206/561; D3/307

(58) Field of Classification Search ..... 248/311.2, 248/304, 211, 213.2, 214, 231.81, 228.7, 248/230.7; 220/533, 735, 736; D3/307, D3/308; 224/567; 206/561
See application file for complete search history.

(56) References Cited

U.S. PATENT DOCUMENTS 1,569,157 A * 1/1926 Thompson ..... 224/610
D102,671 S * 1/1937 Worthington ..... D3/307
2,707,141 A * 4/1955 Witter ..... 108/26
2,985,333 A * 5/1961 Kirkman ..... 220/533
3,200,983 A * 8/1965 Walter ..... 220/533
3,325,038 A * 6/1967 Ferney ..... 52/11
3,477,679 A * 11/1969 Lovitz ..... 248/213.2
3,837,034 A * 9/1974 Leffert et al. ..... 15/257.06
3,986,649 A * 10/1976 Heimstra ..... 224/567
4,552,272 A * 11/1985 Field ..... 211/88.01
4,577,773 A * 3/1986 Bitel ..... 220/533
4,706,918 A * 11/1987 Wilson ..... 248/210
4,739,582 A * 4/1988 Cullinane ..... 47/41.12
4,867,332 A * 9/1989 Mains ..... 220/735
D331,307 S * 11/1992 McConnell ..... D3/308
D333,910 S * 3/1993 Rorke ..... D6/630
5,265,729 A * 11/1993 Carlin ..... 206/561
5,836,043 A * 11/1998 Rovas ..... 15/257.06
5,842,253 A * 12/1998 Ahl et al. ..... 15/257.06
D405,574 S * 2/1999 Riky ..... D32/54
6,170,680 B1 * 1/2001 Hung ..... 211/119.007
6,237,802 B1 * 5/2001 Douglas ..... 220/736
6,443,260 B1 * 9/2002 Katz et al. ..... 182/129

* cited by examiner

*Primary Examiner*—Anita M. King
(74) *Attorney, Agent, or Firm*—John L. James

(57) ABSTRACT

An article holder for a barrel cooler has a lip for fitting on the top end of the barrel sidewall and a tray attached to the lip for holding containers which indicate the contents of the barrel.

7 Claims, 4 Drawing Sheets

ARTICLE HOLDER FOR A BARREL COOLER

TECHNICAL FIELD OF THE INVENTION

This invention relates generally to a beverage cooler, and, more particularly, to an article holder for mounting on a barrel cooler.

BACKGROUND OF THE INVENTION

A beverage cooler in the shape of a barrel is often used to cool and display containers of beverages for sale. Barrel coolers are typically filled with ice and the beverage containers are placed in the ice. Product identification can be placed on the outside of the cooler so that a consumer knows what product is buried in the ice. Such product identification is acceptable when a single cooler contains a single brand and size of product. When a single cooler contains multiple sizes or brands, a consumer must probe the ice with a hand to find a desired item without actually knowing whether that particular item is stocked in the barrel. Accordingly, it will be appreciated that it would be highly desirable to have a way of indicating what products are stocked in the barrel before looking for a particular item.

Snack foods, straws and other items used or consumed with beverages are typically conveniently stocked on shelves or racks near the beverages. It is desirable to have these items as close as possible to the beverages to increase convenience for the consumer and to boost impulse sales.

SUMMARY OF THE INVENTION

The present invention is directed to overcoming one or more of the problems set forth above. Briefly summarized, according to the present invention an article holder for a barrel cooler comprises an inverted U-shaped lip having curved inner and outer vertical lip panels and a top panel connecting top end portions of the inner and outer lip panels and a tray having a curved rear wall connected to the outer lip panel.

The curved vertical lip panels fit over the top of a barrel to hold the tray on the outside of the barrel. Beverage containers can be displayed in the tray to indicate the contents of the barrel so that a consumer will readily know what is in the barrel ready for consumption. Snack foods and other item complimentary to the beverages can also be held in the tray.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
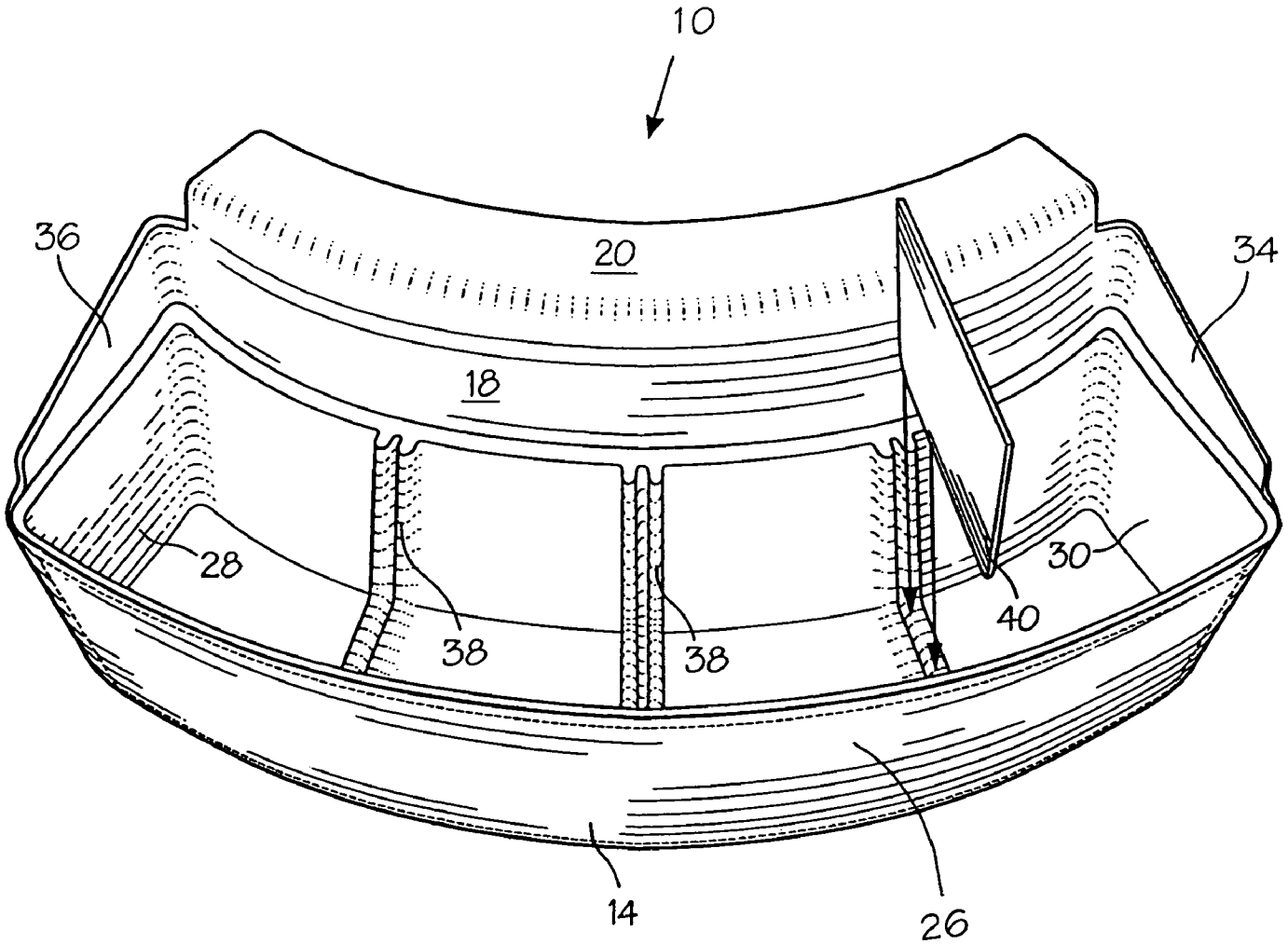
FIG. 1 is a top perspective view of a preferred embodiment of an article holder for a barrel cooler according to the present invention.

Referring to FIGS. 1–4, an article holder 10 is provided for a barrel cooler 12. Barrel cooler 12 has a curved vertical sidewall 14 terminating at a top end of the barrel. The insulated barrel sidewall 14 has a thickness of value T and curves on an inner radius of value $R_i$ and curves on an outer radius of value $R_o$.

The article holder 10 has an inverted U-shaped lip with inner and outer vertical lip panels 16, 18. A top lip panel 20 connects top end portions of inner and outer lip panels 16, 18. Inner lip panel 16 curves at a radius, from the center axis of barrel 12, less than $R_i$ and the outer lip panel 18 curves at a radius, from the center axis of barrel 12, greater than $R_o$. This difference in radiuses allows the lip to fit over the top end of the barrel sidewall.

A tray 22 is connected to outer lip panel 18 and is preferably integrally formed therewith. Tray 22 has a curved rear wall 24 that curves at a radius greater than $R_o$. A front wall 26 is spaced from rear wall 24, and there are opposed left and right sidewalls 28, 30. A bottom wall 32 is connected to the front wall 26, rear wall 24, left sidewall 28 and right sidewall 30 and preferably integrally formed therewith.

A right brace 34 is connected to right sidewall 30, rear wall 24 and outer lip panel 18. A left brace 36 is connected to left sidewall 28, rear wall 24 and outer lip panel 18.

Figure 2:
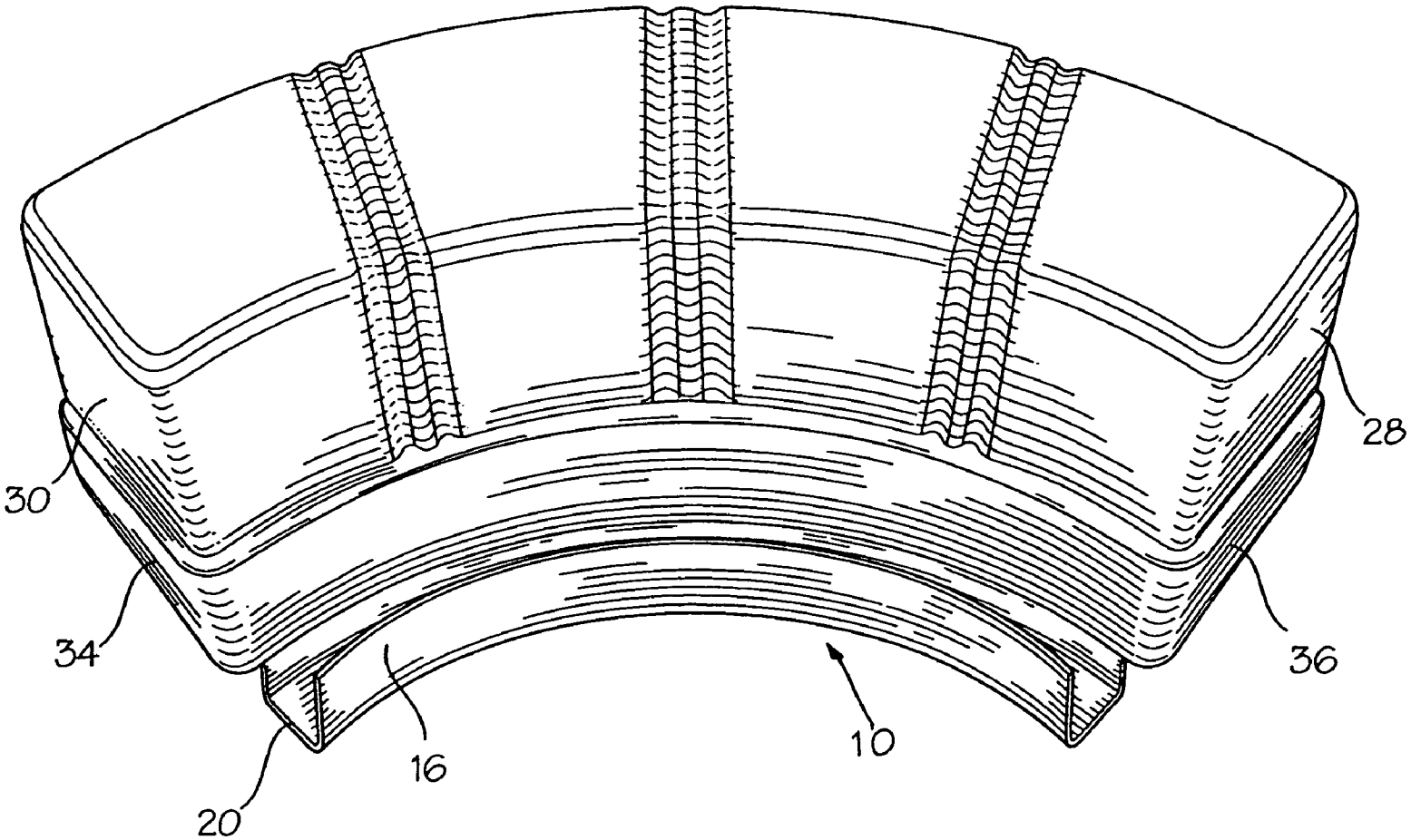
FIG. 2 is a bottom perspective view of the article holder.
Figure 3:
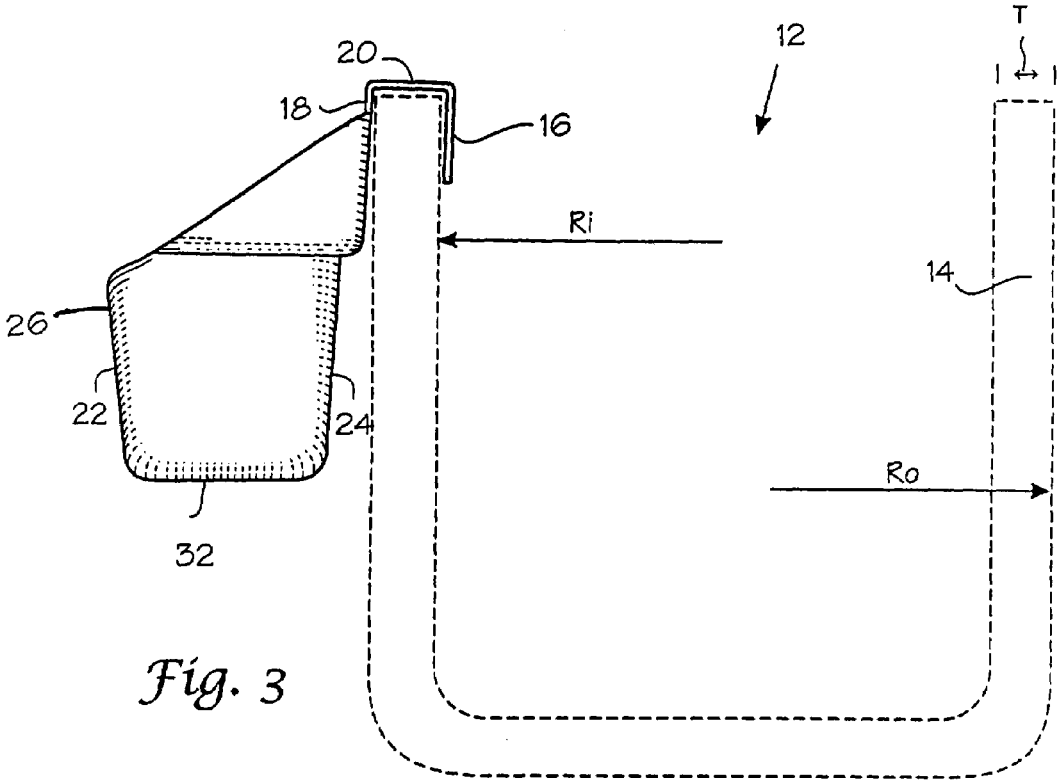
FIG. 3 is a diagrammatic right end view of the article holder.
Figure 4:
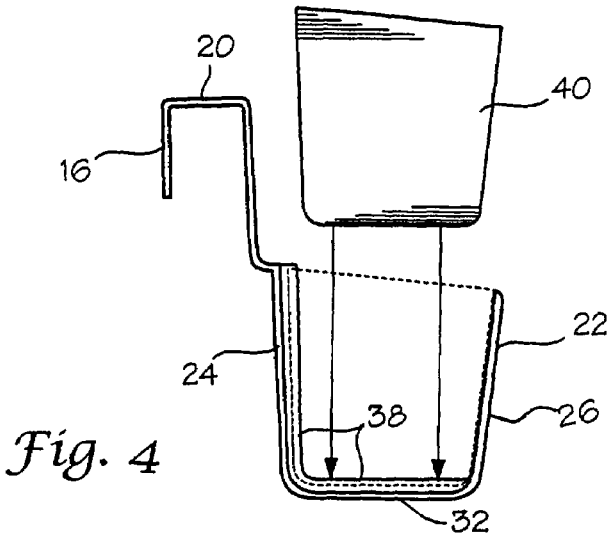
FIG. 4 is a diagrammatic end view of an article holder with a removable tray.

Still referring to FIGS. 1–3, partitions 40 fitted in to grooves 38 divide tray 22 into a plurality of compartments. Each groove 38 preferably extends transversely along the bottom of tray 22 and along the front and rear walls of tray 22, but grooves along the front and rear walls are sufficient. Each partition 40 is preferably a flat panel but curved panels can be used to conform to the contour of an article in the tray. For example, curved panels could be used for cylindrical bottles or the like. Also, removable panels allow certain panels to be removed to accommodate articles of different sizes.

Figure 5:
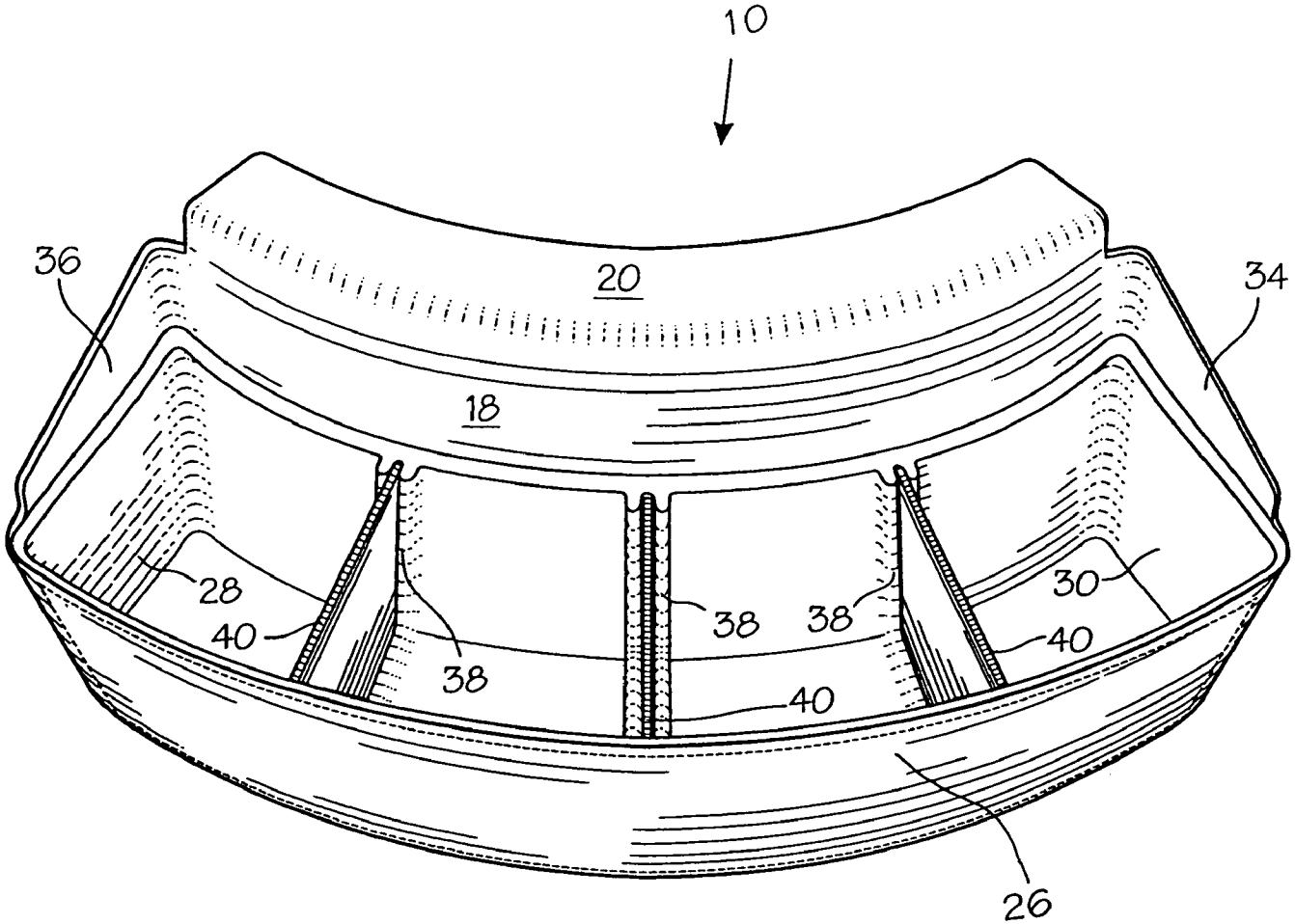
FIG. 5 is a top perspective view of another preferred embodiment of an article holder.

Alternatively, grooves and partitions 40 could be integrally formed with tray 22 (FIG. 5) and partitions could be used without grooves as there would be no need for grooves. The advantage of an integrally formed unit is that it is simple to use.

It can now be appreciated that an article holder for a barrel cooler has been presented wherein the barrel has a curved sidewall of thickness T, an inner radius $R_i$ and an outer radius $R_o$. The article holder has an inverted U-shaped lip with inner and outer vertical lip panels and a top panel connecting top end portions of the lip panels. The inner lip panel has a radius less than $R_i$ and the outer lip panel hast a radius greater than $R_o$. A tray is connected to the outer lip panel and has a curved rear wall of radius greater than $R_o$. The tray has at least one partition dividing the tray into a plurality of compartments. The partition may be connected to the front and rear walls, may be connected to the bottom wall of the tray, or may be removably positioned in grooves in the tray. The tray may be used to indicate the contents of the barrel cooler or to hold snack foods, straws or other items complimentary to the beverages in the cooler.

While the invention has been described with particular reference to the preferred embodiments, it will be understood by those skilled in the art that various changes may be made and equivalents may be substituted for elements of the preferred embodiments without departing from invention. For example, while it is contemplated that the article holder will be constructed of plastic, it can be formed of metal or a composite material. It is accordingly intended that the claims shall cover all such modifications and applications as do not depart from the true spirit and scope of the invention.

ELEMENT LIST

10 article holder
12 barrel cooler
14 barrel sidewall
16 inner lip panel
18 outer lip panel
20 top lip panel
22 tray
24 rear wall
26 front wall
28 left sidewall
30 right sidewall
32 bottom wall
34 right brace
36 left brace
38 grooves
40 partition panels

The invention claimed is:

1. An article holder for a barrel cooler, comprising:

an inverted U-shaped lip having inner and outer vertical lip panels and a top panel connecting top end portions of said inner and outer lip panels, said inner lip panel curving at a first radius and said outer lip panel curving at a second radius greater than said first radius creating a space between said inner and outer vertical lips;

a tray connected to said outer lip panel, said tray having a curved rear wall, a front wall spaced from said rear wall, a left sidewall, a right sidewall, and a bottom wall connected to said front wall, rear wall, left sidewall and right sidewall; and a first brace connected to said right sidewall, rear wall and outer lip panel.

2. An article holder, as set forth in claim 1, including a second brace connected to said left sidewall, rear wall and outer lip panel.

3. An article holder, as set forth in claim 1, including at least one partition dividing said tray into a plurality of compartments.

4. An article holder, as set forth in claim 3, wherein said at least one partition is connected to said front and rear walls.

5. An article holder, as set forth in claim 3, wherein said at least one partition is connected to said bottom wall.

6. An article holder, as set forth in claim 3, wherein said at least one partition is removably positioned in grooves in said front and rear walls.

7. An article holder, as set forth in claim 3, wherein said at least one partition is removably positioned in a groove in said bottom wall.

* * * * *